US011454897B2

(12) United States Patent
Saito et al.

(10) Patent No.: US 11,454,897 B2
(45) Date of Patent: Sep. 27, 2022

(54) DEVELOPING DEVICE AND IMAGE FORMING APPARATUS CONTAINING REGULATED BEARING

(71) Applicant: Ricoh Company, Ltd., Tokyo (JP)

(72) Inventors: Kei Saito, Tokyo (JP); Kunihiro Ohyama, Tokyo (JP); Kentarou Matsumoto, Tokyo (JP); Naohiro Kawashima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/320,461

(22) Filed: May 14, 2021

(65) Prior Publication Data

US 2021/0364942 A1 Nov. 25, 2021

(30) Foreign Application Priority Data

May 21, 2020 (JP) ..... JP2020-089047

(51) Int. Cl.
*G03G 15/02* (2006.01)
*G03G 15/08* (2006.01)
(Continued)

(52) U.S. Cl.
CPC ..... *G03G 15/0216* (2013.01); *G03G 15/0808* (2013.01); *G03G 15/0872* (2013.01);
(Continued)

(58) Field of Classification Search
CPC ..... G03G 15/0216; G03G 15/0808; G03G 15/0872; G03G 15/0891; G03G 21/1652;
(Continued)

(56) References Cited

U.S. PATENT DOCUMENTS 2,884,283 A * 4/1959 Korol ..... F16C 33/20 74/504
5,623,328 A * 4/1997 Tsuda ..... G03G 21/1633 399/111

(Continued)

FOREIGN PATENT DOCUMENTS

| | | |
|---|---|---|
| EP | 2 042 760 A1 | 4/2009 |
| JP | 9-211987 | 8/1997 |
| JP | 2009-276644 | 11/2009 |

OTHER PUBLICATIONS

U.S. Appl. No. 17/064,604, filed Oct. 7, 2020, Kei Saito, et al.
Extended European Search Report dated Oct. 11, 2021 in European Patent Application No. 21173476.9, 10 pages.

*Primary Examiner* — Walter L Lindsay, Jr.
*Assistant Examiner* — Laura Roth
(74) *Attorney, Agent, or Firm* — Xsensus LLP

(57) ABSTRACT

A developing device configured to develop a latent image formed on a surface of an image bearer includes a rotator, a bearing, a holder, a first regulator, and a second regulator. The rotator includes a rotation shaft. The bearing supports the rotation shaft. The holder holds the bearing. The first regulator, disposed on any one of the bearing and the holder, regulates movement of the bearing such that the bearing does not fall toward one end side in an axial direction of the rotation shaft relative to the holder. The second regulator regulates movement of the bearing such that the bearing does not fall toward another end side in the axial direction relative to the holder after the bearing is attached to the holder.

15 Claims, 4 Drawing Sheets

(51) Int. Cl.
*G03G 21/16* (2006.01)
*G03G 21/18* (2006.01)

(52) U.S. Cl.
CPC ..... *G03G 15/0891* (2013.01); *G03G 21/1652* (2013.01); *G03G 21/1647* (2013.01); *G03G 21/1821* (2013.01); *G03G 21/1871* (2013.01)

(58) Field of Classification Search
CPC ..... G03G 2221/1654; G03G 15/0896; G03G 21/1647; G03G 15/0813; G03G 21/1676; G03G 21/1817; G03G 21/1821; G03G 21/1842; G03G 21/1871; G03G 21/1867
See application file for complete search history.

(56) References Cited

U.S. PATENT DOCUMENTS

| | | | | |
|---|---|---|---|---|
| 6,089,484 | A * | 7/2000 | Zwayer | A01K 89/0102 242/321 |
| 6,467,965 | B1 * | 10/2002 | Wyer | G03G 15/0806 384/295 |
| 2014/0363189 | A1 | 12/2014 | Hashimoto et al. | |
| 2015/0293485 | A1 | 10/2015 | Takahashi et al. | |
| 2017/0102663 | A1 | 4/2017 | Tomita et al. | |
| 2017/0108795 | A1 | 4/2017 | Oshikawa et al. | |
| 2017/0115597 | A1 | 4/2017 | Kawashima et al. | |
| 2017/0168418 | A1 | 6/2017 | Takami et al. | |
| 2017/0168421 | A1 | 6/2017 | Koshizuka et al. | |
| 2017/0351195 | A1 | 12/2017 | Koshizuka et al. | |
| 2019/0286013 | A1 | 9/2019 | Saito et al. | |
| 2020/0103824 | A1 | 4/2020 | Oshikawa et al. | |
| 2020/0117119 | A1 | 4/2020 | Mase et al. | |
| 2020/0174400 | A1 | 6/2020 | Kawashima et al. | |
| 2020/0348615 | A1 | 11/2020 | Takahashi et al. | |
| 2021/0041806 | A1 | 2/2021 | Tsuchiya et al. | |
| 2021/0080856 | A1 | 3/2021 | Hashikawa et al. | |

* cited by examiner

DEVELOPING DEVICE AND IMAGE FORMING APPARATUS CONTAINING REGULATED BEARING

CROSS-REFERENCE TO RELATED APPLICATION

This patent application is based on and claims priority pursuant to 35 U.S.C. § 119 to Japanese Patent Application No. 2020-089047, filed on May 21, 2020, in the Japan Patent Office, the entire disclosure of which is hereby incorporated by reference herein.

BACKGROUND

Technical Field

Exemplary aspects of the present disclosure relate to a developing device that develops a latent image formed on a surface of an image bearer such as a photoconductor drum, and to an image forming apparatus including the developing device.

Related Art

Conventionally, in developing devices disposed in image forming apparatuses such as copiers and printers, a technique by which a bearing for supporting a rotation shaft of a developing roller (a rotator) is disposed on a face plate (a holder) that defines a gap between a photoconductor drum (an image bearer) and the developing roller is known.

SUMMARY

In at least one embodiment of this disclosure, there is described an improved developing device configured to develop a latent image formed on a surface of an image bearer. The developing device includes a rotator, a bearing, a holder, a first regulator, and a second regulator. The rotator includes a rotation shaft. The bearing supports the rotation shaft. The holder holds the bearing. The first regulator, disposed on any one of the bearing and the holder, regulates movement of the bearing such that the bearing does not fall toward one end side in an axial direction of the rotation shaft relative to the holder. The second regulator regulates movement of the bearing such that the bearing does not fall toward another end side in the axial direction relative to the holder after the bearing is attached to the holder.

Further described is an improved an image forming apparatus that includes an image bearer, a developing device, a bearing, a holder, a first regulator, and a second regulator. The developing device develops a latent image formed on a surface of the image bearer. The developing device includes a rotator with a rotation shaft. The bearing supports the rotation shaft. The holder holds the bearing. The first regulator is disposed on the bearing and regulates movement of the bearing moving toward one end side in an axial direction of the rotation shaft relative to the holder. The second regulator regulates movement of the bearing moving toward another end side in the axial direction relative to the holder after the bearing is attached to the holder.

Still further described is an improved process cartridge that includes an image bearer, a developing device, a bearing, a holder, a first regulator, and a second regulator. The developing device develops a latent image formed on a surface of the image bearer. The developing device includes a rotator with a rotation shaft. The bearing supports the rotation shaft. The holder holds the bearing. The first regulator is disposed on the bearing and regulates movement of the bearing moving toward one end side in an axial direction of the rotation shaft relative to the holder. The second regulator regulates movement of the bearing moving toward another end side in the axial direction relative to the holder after the bearing is attached to the holder.

BRIEF DESCRIPTION OF THE DRAWINGS

The aforementioned and other aspects, features, and advantages of the present disclosure are better understood by reference to the following detailed description when considered in connection with the accompanying drawings, wherein.

Figure 1:
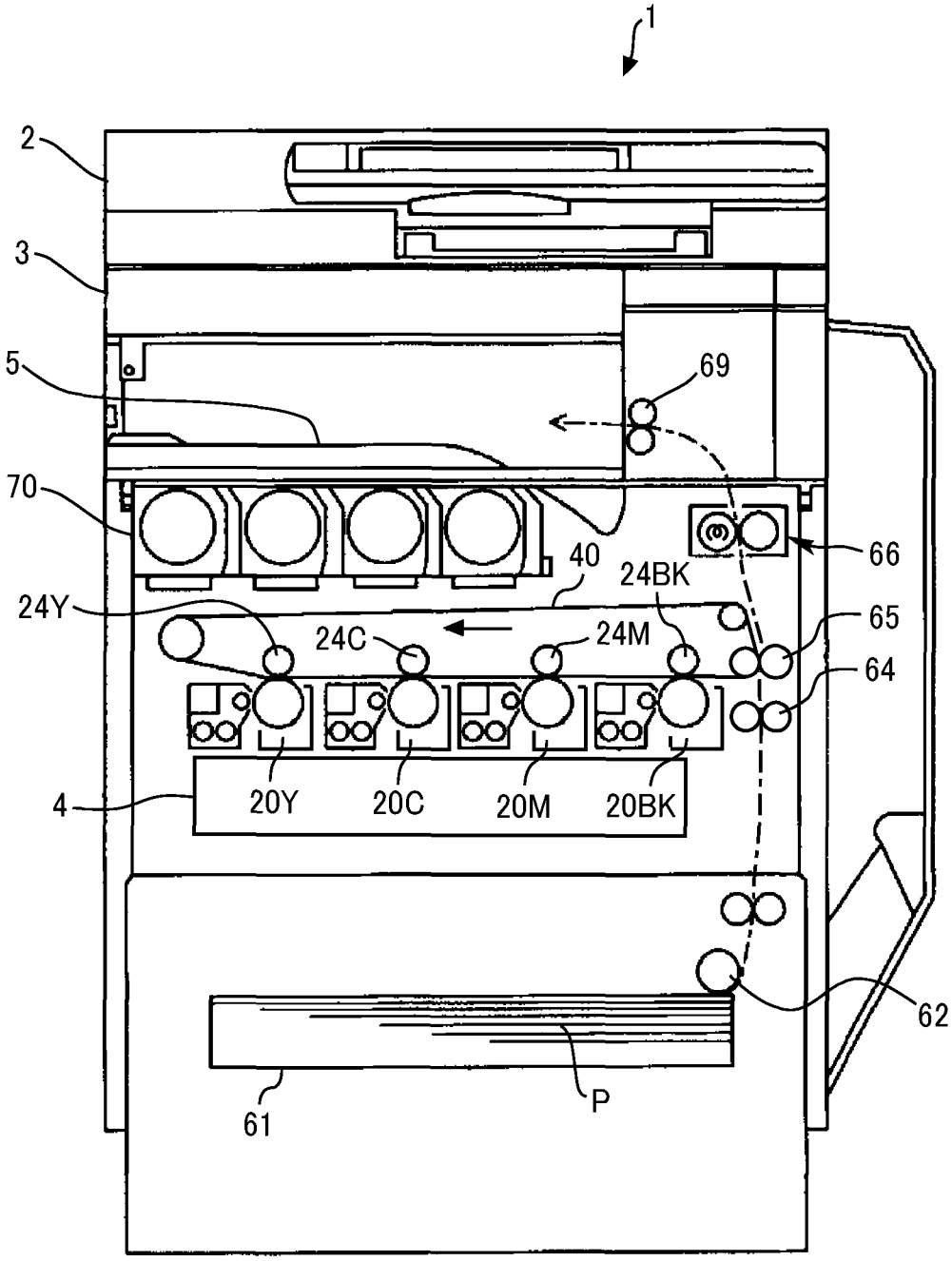
FIG. 1 is a diagram illustrating an overall configuration of an image forming apparatus according to one embodiment of the preset disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Referring now to the drawings, embodiments of the present disclosure are described below. In the drawings for explaining the following embodiments, the same reference codes are allocated to elements (members or components) having the same function or shape and redundant descriptions thereof are omitted below.

First, an overall configuration and operations of an image forming apparatus 1 are described with reference to FIG. 1. The image forming apparatus 1 according to one embodiment of the preset disclosure is a tandem-type color image forming apparatus in which a plurality of process cartridges 20Y, 20C, 20M, and 20BK are aligned opposite an intermediate transfer belt 40. In addition, a developing device 26

(see FIG. 2) is disposed opposite a photoconductor drum 21 of each of the process cartridges 20Y, 20C, 20M, and 20BK.

In FIG. 1, a color copier as the image forming apparatus 1 includes a document conveyance device 2, a document reader 3, a writing device (an exposure device) 4, the process cartridges 20Y, 20C, 20M, and 20BK for respective colors (yellow, magenta, cyan, and black), the intermediate transfer belt 40, a sheet feeding device 61, a secondary transfer roller 65, a fixing device 66, and a toner container 70. The document conveyance device 2 coveys a document to the document reader 3, and the document reader 3 reads image information in the document. The writing device 4 emits a laser beam L based on the image information which has been input. The intermediate transfer belt 40 serves as a belt to which toner images of a plurality of colors are transferred in an overlapping manner. The sheet feeding device 61 stores sheets P such as paper. The secondary transfer roller 65 transfers the toner image formed on the intermediate transfer belt 40 to a sheet P, and the fixing device 66 fixes an unfixed image on the sheet P. The toner container 70 supplies each of color toners to the developing devices 26 for the plurality of respective process cartridges 20Y, 20C, 20M, and 20BK.

Figure 2:
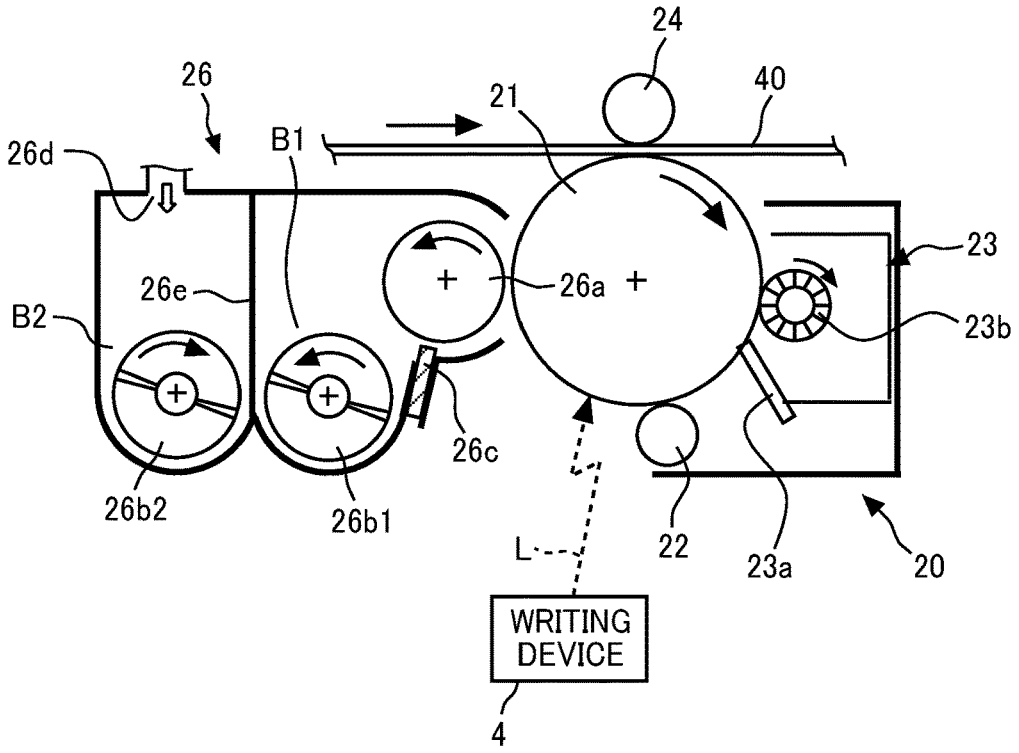
FIG. 2 is a sectional view illustrating an image formation device.

Referring to FIG. 2, each of the process cartridges 20Y, 20C, 20M, and 20BK is integration of the photoconductor drum 21 as an image bearer, a charging device (a charging roller) 22, and a cleaning device 23. Each of the process cartridges 20Y, 20C, 20M, and 20BK is replaced with respect to the image forming apparatus 1 when reaching the lifespan. Each of the developing devices 26 is disposed opposite the photoconductor drum 21 of each of the process cartridges 20Y, 20C, 20M, and 20BK. The developing device 26 is replaced with respect to the image forming apparatus 1 when reaching the lifespan. Attachment and detachment of the developing device 26 to and from the image forming apparatus 1 and attachment and detachment of the process cartridges 20Y, 20C, 20M, and 20BK to and from the image forming apparatus 1 can be separately and independently performed. On the photoconductor drums 21 (the image bearers) in the respective process cartridges 20Y, 20C, 20M, and 20BK, toner images of respective colors (yellow, magenta, cyan, and black) are formed.

Hereinafter, a description is given of a normal operation performed when the image forming apparatus 1 forms a color image. A document is first conveyed from a document tray by a conveyance roller of the document conveyance device 2, and is then placed on an exposure glass of the document reader 3. The document reader 3 optically reads image information in the document placed on the exposure glass. The image information about each of yellow, magenta, cyan, and black is transmitted to the writing device 4. Accordingly, based on the image information about each color, the writing device 4 emits lease beams (exposure light) toward respective surfaces of the photoconductor drums 21 (see FIG. 2) of the respective process cartridges 20Y, 20C, 20M, and 20BK.

Meanwhile, each of the four photoconductor drums 21 rotates clockwise in FIGS. 1 and 2. Then, a surface of each of the photoconductor drums 21 is uniformly charged in a position opposite the charging device 22 (i.e., a charging process is performed). Thus, charging potentials are generated on the photoconductor drums 21. Subsequently, the charged surfaces of the photoconductor drums 21 reach respective exposure positions in which the charged surfaces are irradiated with the laser beams from the writing device 4, and electrostatic latent images based on the image information are formed in the positions (i.e., an exposure process is performed).

A laser beam corresponding to a yellow component is emitted onto the surface of the photoconductor drum 21 of the process cartridge 20Y disposed on the far left among the process cartridges 20Y, 20C, 20M, and 20BK illustrated in FIG. 1. Herein, the laser beam for the yellow component is scanned in a rotation axis direction (a main scanning direction) of the photoconductor drum 21 by a polygon mirror that rotates at high speed. Accordingly, an electrostatic latent image corresponding to the yellow component is formed on the photoconductor drum 21, which has been charged by the charging device 22. Similarly, a laser beam corresponding to a cyan component is emitted onto the surface of the photoconductor drum 21 of the process cartridge 20C disposed on the second from the left among the four process cartridges 20Y, 20C, 20M, and 20BK illustrated in FIG. 1, so that an electrostatic latent image corresponding to the cyan component is formed. A laser beam corresponding to a magenta component is emitted onto the surface of the photoconductor drum 21 of the process cartridge 20M disposed on the third from the left among the four process cartridges 20Y, 20C, 20M, and 20BK illustrated in FIG. 1, so that an electrostatic latent image corresponding to the magenta component is formed. A laser beam corresponding to a black component is emitted onto the surface of the photoconductor drum 21 of the process cartridge 20BK disposed on the fourth from the left among the four process cartridges 20Y, 20C, 20M, and 20BK illustrated in FIG. 1, so that an electrostatic latent image corresponding to the black component is formed.

Subsequently, the surfaces of the photoconductor drums 21 with the electrostatic latent images of the respective colors reach positions opposite the respective developing devices 26. The developing devices 26 supply respective color toners to the photoconductor drums 21, thereby developing the electrostatic latent images on the photoconductor drums 21 (i.e., a developing process is performed). Subsequent to the developing process, the surfaces of the photoconductor drums 21 reach respective positions opposite the intermediate transfer belt 40. Herein, in such positions opposite the intermediate transfer belt 40, primary transfer rollers 24Y, 24C, 24M, and 24BK are disposed so as to contact an inner circumferential surface of the intermediate transfer belt 40. In positions of the primary transfer rollers 24Y, 24C, 24M, and 24BK, the toner images of the respective colors formed on the photoconductor drums 21 are sequentially overlapped and transferred to the intermediate transfer belt 40 (i.e., a primary transfer process is performed).

The surfaces of the photoconductor drums 21 subsequent to the primary transfer process reach positions opposite the respective cleaning devices 23. The cleaning device 23 collects untransferred toner remaining on the photoconductor drum 21 (i.e., a cleaning process is performed). Then, a residual potential on the surface of the photoconductor drum 21 is removed in a position of a discharging device, and a series of image forming processes in the photoconductor drum 21 ends.

On the other hand, a surface of the intermediate transfer belt 40 to which the images of the respective colors on the photoconductor drums 21 have been overlapped and transferred moves in a direction indicated by an arrow in FIG. 1 and reaches a position of the secondary transfer roller 65. In the position of the secondary transfer roller 65, the full color image on the intermediate transfer belt 40 is secondarily transferred to a sheet P (i.e., a secondary transfer process is performed). Then, the surface of the intermediate transfer belt 40 reaches a position of an intermediate transfer belt cleaning device. The intermediate transfer belt cleaning device collects untransferred toner remaining on the intermediate transfer belt 40, and a series of the transfer processes on the intermediate transfer belt 40 ends.

Herein, the sheet P to be conveyed to a position of the secondary transfer roller 65 is conveyed from the sheet feeding device 61 via a roller such as a registration roller 64. Particularly, the sheet P fed by a sheet feeding roller 62 from the sheet feeding device 61 in which sheets P are stored passes a conveyance path, and then is guided to a position of the registration roller 64. Such a sheet P, which has reached the position of the registration roller 64, is conveyed toward a position of the secondary transfer roller 65 in synch with the toner image on the intermediate transfer belt 40.

Then, the sheet P on which the full color image has been transferred is guided to a position of the fixing device 66. The fixing device 66 fixes the color image on the sheet Pin a nip between a fixing roller and a pressure roller. Subsequent to the fixing process, the sheet P is ejected outside the image forming apparatus 1 as an output image by an ejection roller 69. The ejected sheet P is stacked on an ejection tray 5, and a series of image forming processes is completed.

Next, an image formation device of the image forming apparatus 1 is described in detail with reference to FIGS. 2 and 3. Since configurations of four image formation devices that are disposed in the image forming apparatus 1 are similar to every other except for the color of toner to be used in the image forming processes, alphabetical suffixes (Y, C, M, and BK) to numerical values indicating components of the process cartridges and the developing devices are omitted in the drawings.

As illustrated in FIG. 2, the process cartridge 20 mainly includes the photoconductor drum 21 as an image bearer, the charging device 22, and the cleaning device 23 that are integrally stored in a case. The photoconductor drum 21 is an organic photoconductor having a negative chargeability, and includes a photoconductive layer on a drum-shaped conductive support member. The charging device 22 is a charging roller that includes a metal core the outer circumference of which is covered with an elastic layer having moderate electrical resistance. A predetermined voltage is applied to the charging device 22 (the charging roller) from a power source, so that a surface of the photoconductor drum 21 opposite the charging device 22 is uniformly charged. The cleaning device 23 includes a cleaning blade 23*a* and a cleaning roller 23*b* that contact the photoconductor drum 21. The cleaning blade 23*a* is made of a rubber material such as urethane rubber, and is in contact with the surface of the photoconductor drum 21 not only at a predetermined angle but also with a predetermined pressure. The cleaning roller 23*b* is a brush roller that includes a metal core around which brush hair is provided.

Figure 3:
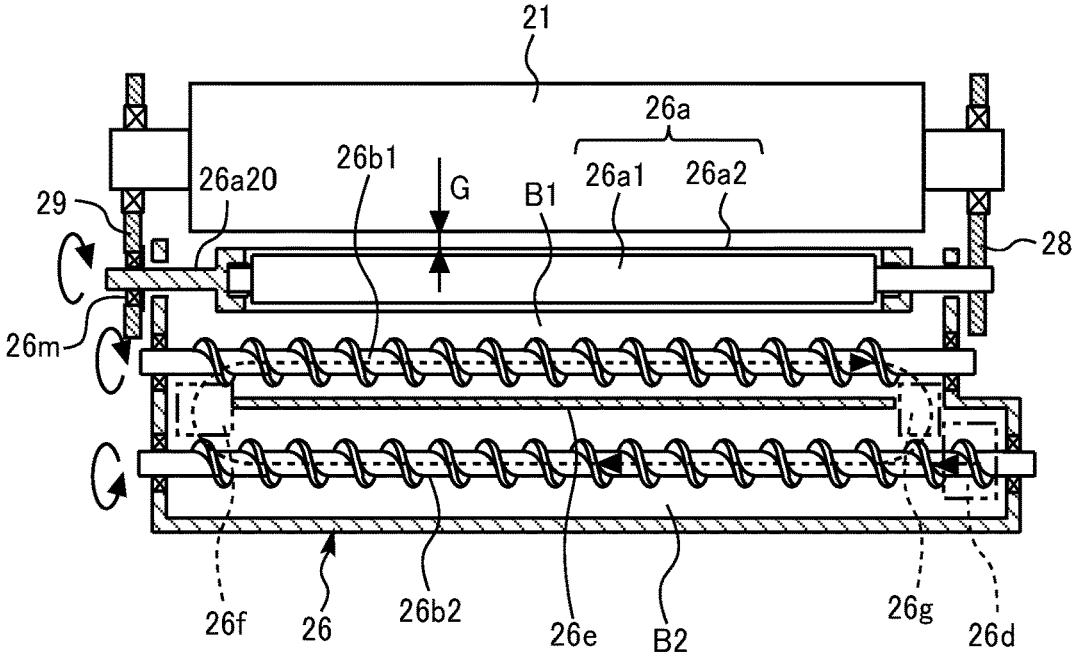
FIG. 3 is a diagram illustrating a developing device and a photoconductor drum in a longitudinal direction.

As illustrated in FIGS. 2 and 3, the developing device 26 mainly includes a developing roller 26*a* (a rotator) as a developer bearer, a first conveyance screw 26*b*1 (a first conveyance member) disposed opposite the developing roller 26*a*, a second conveyance screw 26*b*2 (a second conveyance member) disposed opposite the first conveyance screw 26*b*1 via a partition 26*e* (a wall), and a doctor blade 26*c* (a developer regulator) disposed opposite the developer roller 26*a*. The doctor blade 26*c* regulates an amount of developer on the developing roller 26*a*.

In the developing device 26, a developer (a two-component developer) containing toner and carrier is stored. The developing roller 26*a* is configured such that a development area is formed opposite the photoconductor drum 21 with a small development gap G (an opposed distance) with respect to the photoconductor drum 21. As illustrated in FIG. 3, the developing roller 26*a* includes a magnet 26*a*1 and a sleeve 26*a*2. The magnet 26*a*1 is disposed inside the developing roller 26*a* in a non-rotation manner to form a plurality of poles (magnetic poles) on the outer circumferential surface of the developing roller 26*a*, and the sleeve 26*a*2 rotates around the magnet 26*a*1. The development gap G (the opposed distance) between the developing roller 26*a* and the photoconductor drum 21 is set with good accuracy by two face plates 28 and 29 (positioning determiners) (see FIG. 3) in both end portions (both axial end portions) of the developing roller 26*a* and the photoconductor drum 21 in a longitudinal direction. Each of the face plates 28 and 29 defines a shaft center-to-center distance between the developing roller 26*a* and the photoconductor drum 21.

The first and second conveyance screws 26*b*1 and 26*b*2 convey developer stored inside the developing device 26 in the longitudinal direction to form a circulation path (a broken-line arrow in FIG. 3 indicates the circulation path). That is, a first conveyance path B1 by the first conveyance screw 26*b*1 and a second conveyance path B2 by the second conveyance screw 26*b*2 form the circulation path for developer. The first conveyance path B1 and the second conveyance path B2 are partitioned by the partition 26*e* (the wall), and both end portions of the two conveyance paths B1 and B2 in the longitudinal direction communicate with each other via first and second communication ports 26*f* and 26*g*. Particularly, as illustrated in FIG. 3, an end portion on an upstream side of the first conveyance path B1 in a conveyance direction and an end portion on a downstream side of the second conveyance path B2 in a conveyance direction communicate with each other via the first communication port 26*f*. Moreover, an end portion on a downstream side of the first conveyance path B1 in the conveyance direction and an end portion on an upstream side of the second conveyance path B2 in the conveyance direction communicate with each other via the second communication port 26*g*. That is, the partition 26*e* is disposed in a position except for the both end portions in the longitudinal direction. The first conveyance screw 26*b*1 (the first conveyance path B1) is disposed opposite the developing roller 26*a*, whereas the second conveyance screw 26*b*2 (the second conveyance path B2) is disposed opposite the first conveyance screw 26*b*1 (the first conveyance path B1) via the partition 26*e*. The first conveyance screw 26*b*1 supplies developer toward the developing roller 26*a* while conveying the developer in the longitudinal direction (a horizontal direction in FIG. 3, that is, an axial direction), and collects post-developing-process developer removed from the developing roller 26*a*. The second conveyance screw 26*b*2 agitates and mixes the post-developing-process developer conveyed from the first conveyance path B1 with fresh toner supplied from a supply port 26*d* while conveying the post-developing-process developer and the fresh toner in the longitudinal direction. In the present embodiment, the two conveyance screws 26*b*1 and 26*b*2 are aligned in a horizontal direction. Each of the two conveyance screws 26*b*1 and 26*b*2 includes a shaft around which a screw portion is wound.

The aforementioned image forming process is described in detail by mainly referring to the developing process. The developing roller 26*a* (the developer bearer) as a rotator rotates in a direction indicated by an arrow illustrated in FIG. 2. The first and second conveyance screws 26*b*1 and 26*b*2 are disposed such that the partition 26*e* is disposed between the first and second conveyance screws 26*b*1 and 26*b*2. Rotation of the first and second conveyance screws 26*b*1 and 26*b*2 in directions indicated by respective arrows illustrated FIG. 3 circulates the developer inside the developing device 26 in the longitudinal direction (in a direction indicated by a broken arrow illustrated in FIG. 3) while agitating and mixing the developer with the toner supplied from the supply port 26*d* via a toner supply path from the toner container 70. Then, toner that has adhered to carrier by triboelectric charging is supplied with the carrier to the developing roller 26*a* by a developer supply pole formed on the developing roller 26*a*. The developer on the developing roller 26*a* is conveyed in a direction indicated by an arrow illustrated in FIG. 2, and reaches a position opposite the doctor blade 26*c*. In the position, an amount of the developer on the developing roller 26*a* is appropriately adjusted. Then, the developer having an appropriate amount is conveyed to a position (a developing area) opposite the photoconductor drum 21. An electric field formed in the developing area causes the toner to adhere to the latent image formed on the photoconductor drum 21. Subsequently, the developer remaining on the developing roller 26*a* reaches a position above the first conveyance path B1 with rotation of the sleeve 26*a*2. In the position, the developer remaining on the developing roller 26*a* is removed from the developing roller 26*a*. The electric field in the developing area is formed by a predetermined voltage (a developing bias) to be applied to the developing roller 26*a* by a development power source and a surface potential (a latent image potential) to be formed on a surface of the photoconductor drum 21 by a charging process and an exposure process.

The toner inside the toner container 70 is supplied to the developing device 26 as necessary from the supply port 26*d* with consumption of the toner inside the developing device 26. The consumption of the toner inside the developing device 26 is detected by a toner density sensor that magnetically detects a toner density of the developer (a proportion of toner in the developer) inside the developing device 26. The supply port 26*d* is disposed on one end of the second conveyance screw 26*b*2 in the longitudinal direction (a horizontal direction in FIG. 3) and above the second conveyance screw 26*b*2 (the second conveyance path B2).

A configuration and operations of the developing device 26 according to the embodiment are described in detail. As described above with reference to FIGS. 2 and 3, the developing device 26, which develops a latent image formed on a surface of the photoconductor drum 21 (the image bearer), includes the developing roller 26*a* as a developer bearer disposed opposite the photoconductor drum 21. Such a developing roller 26*a* is a rotator including a rotation shaft 26*a*20. More particularly, as illustrated in FIG. 3, the developing roller 26*a* includes the sleeve 26*a*2 with the rotation shaft 26*a*20 formed on one end side in the longitudinal direction, and the magnet 26*a*1 held inside the sleeve 26*a*2. In the developing device 26, the sleeve 26*a*2 is rotatably supported via a bearing 26*m*, and the magnet 26*a*1 is non-rotatably supported.

Herein, as illustrated in FIGS. 4A, 4B, 5A and 5B, the bearing 26*m* is a ball bearing and rotatably supports the rotation shaft 26*a*20 of the developing roller 26*a* (the sleeve 26*a*2). Particularly, the bearing 26*m* (the ball bearing) is disposed with a plurality of balls that are rollable between an inner ring and an outer ring each of which is made of a conductive metal material. Moreover, conductive grease is filled between the inner ring and the outer ring, and a sealant that prevents leakage of the conductive grease is disposed on each of both end sides. According to the bearing 26*m* having such a configuration, when the rotation shaft 26*a*20 is rotated by a drive mechanism, rolling of the balls rotates the inner ring of the bearing 26*m* with the rotation of the rotation shaft 26*a*20. Herein, although the outer ring is not rotatable, the outer ring is electrically connected to the inner ring by the conductive grease or the balls.

In the developing device 26, as described above with reference to FIG. 3, the two face plates 28 and 29 (the positioning determiners), which define the development gap G as an opposed distance between the photoconductor drum 21 (the image bearer) and the developing roller 26*a* (the developer bearer), are detachably disposed. Particularly, each of the face plates 28 and 29 has two holes that are formed with high positional accuracy. The two holes support a shaft of the photoconductor drum 21 and a shaft of the developing roller 26*a* (the rotation shaft 26*a*20 in a case of the face plate 29 on the left side in FIG. 3). Accordingly, a distance between the shaft of the photoconductor drum 21 and the shaft of the developing roller 26*a* is defined, and the development gap G between the photoconductor drum 21 and the developing roller 26*a* is set to a target value with high accuracy. Moreover, each of the face plates 28 and 29 is detachable from the developing roller 26*a* (the developing device 26) and the photoconductor drum 21 (the process cartridge 20) in a horizontal direction in FIG. 3 as an attachment-detachment direction. The face plates 28 and 29 are attached or detached when the developing device 26 or the process cartridge 20 is replaced or undergoes maintenance.

Out of the two face plates 28 and 29, the face plate 29 (the face plate which is on the left side in FIG. 3 and positioned on the rear side of the developing device 26 in an attachment direction with respect to the image forming apparatus 1) functions as a holder that holds the bearing 26*m*. Particularly, the face plate 29 has a hole having a hole diameter that is substantially the same as an outer diameter of the bearing 26*m*, and the bearing 26*m* is inserted into the hole.

Figure 4A:
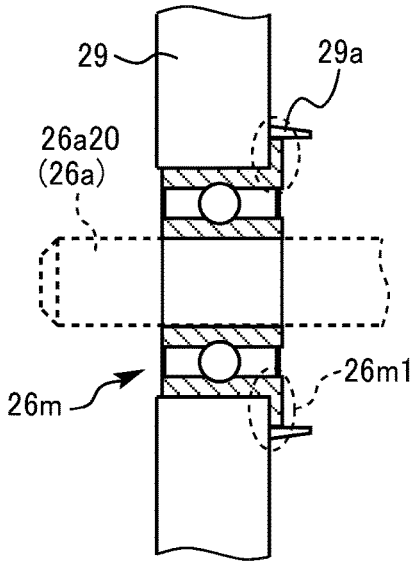
FIG. 4A is a sectional view illustrating vicinity of a bearing in the developing device before a second regulator is deformed.
Figure 4B:
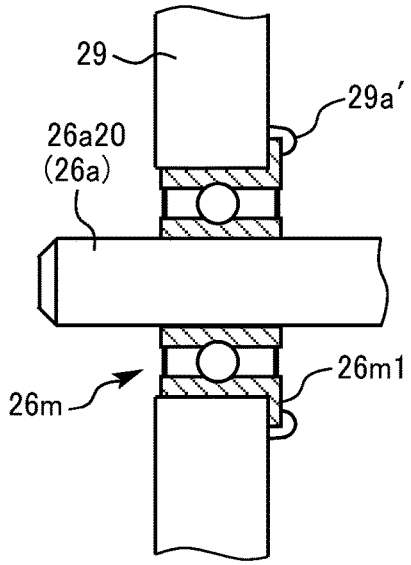
FIG. 4B is a sectional view illustrating the vicinity of the bearing in the developing device after the second regulator is deformed.

Moreover, a first regulator (a brim 26*m*1) is disposed on any one of the bearing 26*m* and the face plate 29 (the holder) to regulate movement of the bearing 26*m* such that the bearing 26*m* does not fall toward one end side in an axial direction (toward the left in FIGS. 3, 4A, and 4B) relative to the face plate 29. In the present embodiment, the brim 26*m*1 as the first regulator is formed on the bearing 26*m*. Particularly, in the bearing 26*m*, the brim 26*m*1 has an outer diameter that is larger than an outer diameter of the other portion (a portion to be inserted into the hole of the face plate 29). Accordingly, the brim 26*m*1 contacts the face plate 29, so that movement of the bearing 26*m* toward the left in FIGS. 3, 4A and 4B is regulated. That is, an unfavorable situation in which the bearing 26*m* is removed toward one end side in a width direction is prevented.

In the developing device 26 according to the present embodiment, as illustrated in FIG. 4B, a second regulator 29*a*' is formed. The second regulator 29*a*' regulates movement of the bearing 26*m* such that the bearing 26*m* does not fall to the other side in the axial direction (toward the right in FIG. 4B) relative to the face plate 29 after the bearing 26*m* is attached to the face plate 29 (the holder). Particularly, a second regulator 29*a* is formed on the face plate 29 (the holder) so as not to contact the bearing 26*m* when the bearing 26*m* is to be attached to the face plate 29 as illustrated in FIG. 4A, and so as to be deformed to become capable of contacting the bearing 26*m* after the bearing 26*m* is attached to the face plate 29 as illustrated in FIG. 4B. In the present embodiment, the second regulator 29*a* represents a pre-deformation second regular, and the second regulator 29*a*' represents a post-deformation second regulator.

That is, the bearing 26*m* is assembled with respect to the face plate 29 by the following procedure. First, as illustrated in FIG. 4A, the bearing 26*m* is moved from the right to the left, and is inserted into the hole of the face plate 29. Thus, the brim 26*m*1 of the bearing 26*m* contacts a side surface (an edge portion of the hole) of the face plate 29. On the other hand, the second regulator 29*a* is integrally formed in a claw shape on the face plate 29 such that the second regulator 29*a* stands toward the other end side in the attachment direction (toward the right in FIG. 4A) of the bearing 26*m*. Thus, the bearing 26*m* is attached to the face plate 29 without hindrance by the second regulator 29*a*. That is, when the bearing 26*m* is attached, the second regulator 29*a* does not contact the bearing 26*m* (the brim 26*m*1). Even in a case where the second regulator 29*a* contacts the bearing 26*m*, attachment of the bearing 26*m* is not hindered. As illustrated in FIG. 4B, after attachment of the bearing 26*m* to the face plate 29 is completed, the second regulator 29*a* is deformed by heat or pressure and the second regulator 29*a*' (the post-deformation second regulator) is swaged to cover the periphery of the bearing 26*m* (the brim 26*m*1). Accordingly, even if the bearing 26*m* is intended to be moved toward the right in FIG. 4B, the second regulator 29*a*' is caught on the brim 26*m*1. Hence, the rightward movement of the bearing 26*m* is regulated. That is, movement (falling) of the bearing 26*m* toward both sides in the axial direction is regulated by the first regulator (the brim 26*m*1) and the second regulator 29*a*'.

The arrangement of the first regulator (the brim 26*m*1) and the second regulator 29*a*' prevents an unfavorable situation in which the bearing 26*m* falls (is removed) from the face plate 29 when the face plate 29 is attached to and detached from the developing device 26 (or the process cartridge 20) during operation such as maintenance. Therefore, an unfavorable situation in which the bearing 26*m* is damaged due to falling is prevented, and operability of attachment and detachment of the face plate 29 is enhanced.

Figure 5A:
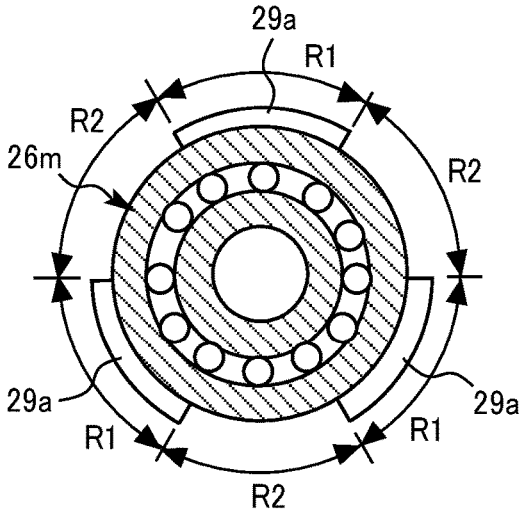
FIGS. 5A and 5B are diagrams each illustrating relative positions of a plurality of second regulators with respect to the bearing.
Figure 5B:
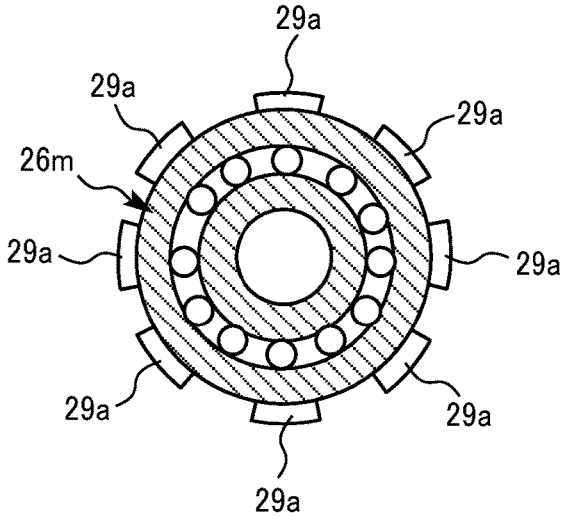

In the present embodiment, as illustrated in FIGS. 5A and 5B, a plurality of second regulators 29*a* (pre-deformation second regulators) is disposed apart from each other around the bearing 26*m*. Particularly, in the example illustrated in FIG. 5A, three second regulators 29*a* are separately disposed in a circumferential direction. In the example illustrated in FIG. 5B, eight second regulators 29*a* are separately disposed in a circumferential direction. However, the number of second regulators 29*a* is not limited to the examples illustrated in FIGS. 5A and 5B. Accordingly, a plurality of second regulators 29*a* is separately disposed in a circumferential direction, so that the second regulators 29*a* can be deformed by heat or pressure more easily than a case in which a single second regulator 29*a* is disposed in the entire area in a circumferential direction.

In the present embodiment, moreover, the plurality of second regulators 29*a* is disposed apart from each other in a substantially equidistant manner as illustrated in FIG. 5A. Accordingly, in a case where a force that pulls out the bearing 26*m* toward the right in FIG. 4B acts, the plurality of second regulators 29*a* disperses and receives the force in a substantially even manner. That is, stress concentration on a predetermined second regulator 29*a* can be avoided. Thus, the use of the second regulators 29*a* efficiently provides an effect in which the bearing 26*m* is prevented from falling. The plurality of second regulators 29*a* is preferably disposed apart from each other in a substantially equidistant manner because of the aforementioned reason. However, a plurality of second regulators 29*a* having different circumferential lengths may be dispersedly disposed to some extent in a circumferential direction (e.g., a plurality of second regulators 29*a* is symmetrically disposed with respect to a vertical line passing through the center of the bearing 26*m*), instead of the substantially equidistant manner. Even in such a case, an effect similar to the above-described effect can be acquired to some extent.

In the present exemplary embodiment, the plurality of second regulators 29*a* is disposed such that a proportion (hereinafter referred to as a cover rate X) of the second regulators 29*a* excluding all the clearance in the circumference of the bearing 26*m* is 50% or higher. Particularly, referring to FIG. 5A, a cover rate X is expressed as X (%)=R1×3/(R1×3+R2×3)×100. If a cover rate X of the second regulators 29*a* becomes higher, a force (hereinafter referred to as a pull-out strength) by which the second regulators 29*a* prevent the bearing 26*m* from being pulled out (falling) becomes proportionally stronger. The rotation shaft 26*a*20 may burn and adhere to an inner ring of the bearing 26*m* (the ball bearing) over time. In such a case, a great force acts on the second regulators 29*a* when the face plate 29 (the bearing 26*m*) is removed from the developing device 26 (the rotation shaft 26*a*20). Even in such a case, the second regulators 29*a* can prevent the bearing 26*m* from falling as long as a cover rate X is 50% or higher. In the present embodiment, the rotation shaft 26*a*20 having a diameter of 6 mm and made of stainless steel is rotated at 750 revolutions per minute (rpm), and a cover rate X of the second regulator 29*a* is set to approximately 58% (a pull-out strength of 130N) to prevent the bearing 26*m* from falling.

Figure 6:
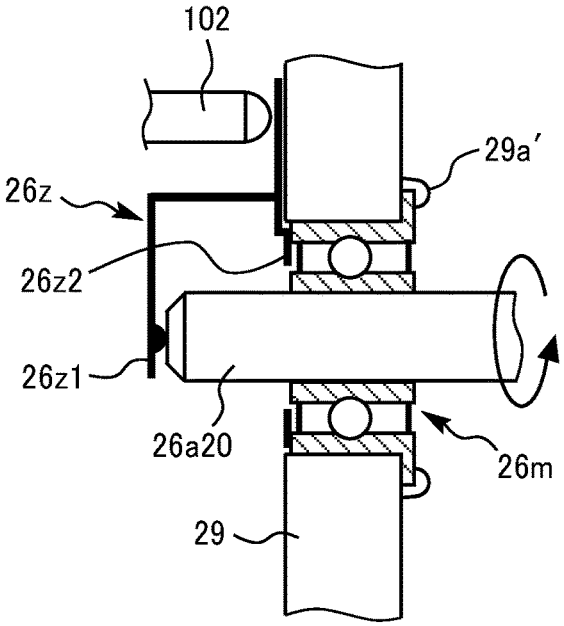
FIG. 6 is a diagram illustrating a principal portion of the developing device in a state in which an electrode is set.

Herein, as illustrated in FIG. 6, the developing device 26 according to the present embodiment includes an electrode 26*z* that contacts an end surface of the rotation shaft 26*a*20 of the developing roller 26*a* and an end surface of the bearing 26*m*. The electrode 26*z* is used to apply a predetermined voltage (a developing bias) to the developing roller 26*a* by the development power source. Particularly, when the developing device 26 is attached to the image forming apparatus 1, the electrode 26*z* of the developing device 26 contacts a terminal 102 (see FIG. 6) connected to the development power source disposed in the image forming apparatus 1. A developing bias is supplied from the electrode 26*z* to the developing roller 26*a* via the terminal 102. Herein, the electrode 26*z* includes a first current-applying portion 26*z*1 that contacts an end surface of the rotation shaft 26*a*20 and a second current-applying portion 26*z*2 that contacts an end surface of the bearing 26*m* (particularly, the outer ring). That is, the electrode 26*z* is configured such that a developing bias can be applied to the developing roller 26*a* by using two bias paths. Accordingly, even if one bias path is blocked by any reason, such a configuration in which the developing bias can be applied to the developing roller 26*a* by the two bias paths enables a developing bias to be applied to the developing roller 26*a* by using the other bias path.

In addition, the first current-applying portion 26*z*1 has a tip that is formed in a substantially hemispheric shape. The first current-applying portion 26*z*1 is disposed such that the substantially-hemispheric-shaped tip contacts a center of the end surface of the rotation shaft 26*a*20. Such an arrangement enables wear on the sub stantially-hemi spheric-shaped tip over time to be reduced. In addition, since the second current-applying portion 26*z*2 is configured to contact the end surface of the bearing 26*m* as similar to a case in which the second current-applying portion 26*z*2 is configured to contact an outer circumferential surface of the bearing 26*m*, attachment of the bearing 26*m* to the hole of the face plate 29 is not hindered. The bearing 26*m* is regulated by the first regulator (the brim 26*m*1) and the second regulator 29*a*' such that the bearing 26*m* barely moves in an axial direction in the face plate 29, and thus an unfavorable situation in which the bearing 26*m* becomes wobbly and inclined relative the face plate 29 does not tend to occur. Accordingly, a contact state of the electrode 26*z* with respect to the bearing 26*m* or the rotation shaft 26*a*20 is stable, so that a failure to apply a bias to the developing roller 26*a* due to a contact failure of the electrode 26*z* does not tend to occur.

Modified Example

Figure 7A:
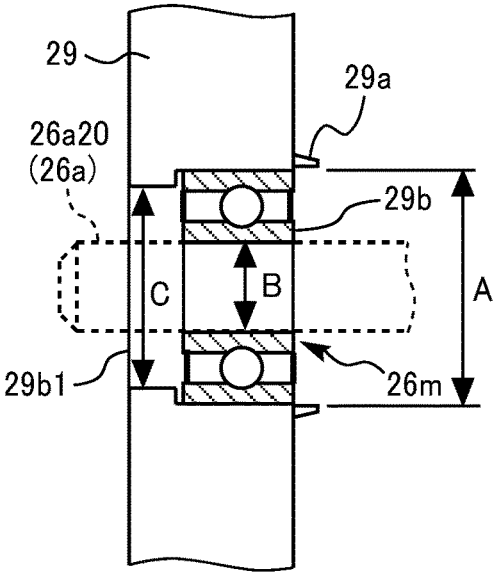
FIG. 7A is a sectional view illustrating vicinity of a bearing in a developing device before a second regulator is deformed as a modified example.
Figure 7B:
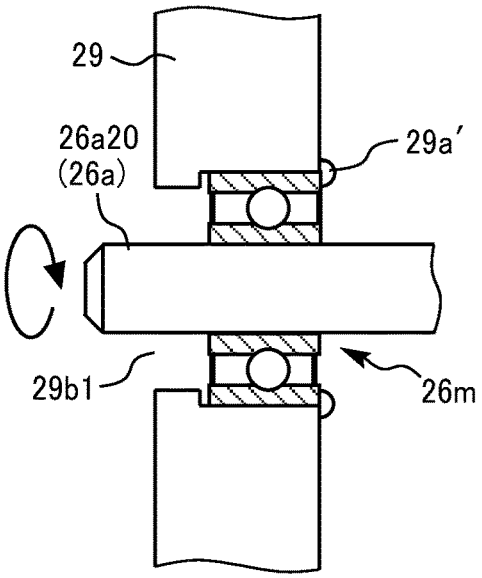
FIG. 7B is a sectional view illustrating the vicinity of the bearing in the developing device after the second regulator is deformed as the modified example.

As illustrated in FIGS. 7A and 7B, a bearing 26*m* according to a modified example does not include a brim 26*m*1 functioning as a first regulator. That is, an outer shape of the bearing 26*m* according to the modified example is formed in a substantially cylindrical shape. In the modified example, a small hole 29*b*1 functioning as a first regulator is formed on a face plate 29 (a holder), instead of the bearing 26*m*. The small hole 29*b*1 regulates movement of the bearing 26*m* relative to the face plate 29 such that the bearing 26*m* does not fall toward one end side in an axial direction (toward the left in FIGS. 7A and 7B). In the modified example, the first regulator is the small hole 29*b*1 formed on the face plate 29. In the face plate 29, as illustrated in FIG. 7A, the small hole 29*b*1 (the first regulator) is formed in a hole 29*b* to which the bearing 26*m* is to be attached. The small hole 29*b*1 has a hole diameter C that is larger than an inner diameter B of the bearing 26*m* and smaller than an outer diameter A of the bearing 26*m* (i.e., B<C<A). In the modified example, since a ball bearing is used as the bearing 26*m*, the hole diameter C of the small hole 29*b*1 is set to be larger than an outer diameter of an inner ring of the bearing 26*m* such that rotation of the inner ring of the bearing 26*m* is not hindered. Even such a small hole 29*b*1 as the first regulator regulates movement (falling) of the bearing 26*m* toward the left in FIG. 7A when the bearing 26*m* contacts a step of the small hole 29*b*1. The first regulator (the small hole 29*b*1) and a second regulator (post-deformation second regulator) 29*a*' prevent an unfavorable situation in which the bearing 26*m* falls (is removed) from the face plate 29. In the modified example, since the bearing 26*m* does not have a brim 26*m*1, the post-deformation second regulator 29*a*', as illustrated in FIG. 7B, is swaged with heat or pressure to directly contact an outer ring of the bearing 26*m*.

Therefore, the developing device 26 according to the above-described embodiment develops a latent image formed on a surface of the photoconductor drum 21 (an image bearer), and includes the developing roller 26*a* (a rotator) which includes the rotation shaft 26*a*20, the bearing 26*m* which supports the rotation shaft 26*a*20, and the face plate 29 (a holder) which holds the bearing 26*m*. In addition, the developing device 26 includes the brim 26*m*1 (a first regulator) disposed on any one of the bearing 26*m* and the face plate 29. The brim 26*m*1 regulates movement of the bearing 26*m* such that the bearing 26*m* does not fall toward one end side in an axial direction relative to the face plate 29. The developing device 26 also includes the second regulator 29*a*. The second regulator 29*a* regulates movement of the bearing 26*m* such that the bearing 26*m* does not fall toward the other end side in the axial direction relative to the face plate 29 after the bearing 26*m* is attached to the face plate 29. Accordingly, when the face plate 29 (the holder) is attached to and detached from the developing device 26, the occurrence of an unfavorable situation in which the bearing 26*m* falls from the face plate 29 can be reduced.

In the above-described embodiment, the developing device 26 can be independently attached to and detached from the image forming apparatus 1, instead of a configuration in which the developing device 26 is a component of the process cartridge 20. However, the developing device 26 may be configured as one of components of the process cartridge 20 so as to be integrally attached and detached as the process cartridge 20 to and from the image forming apparatus 1. Even in such a case, an effect similar to the effect obtained by the above-described embodiment can be obtained. In the present disclosure, the term "process cartridge" is defined as an assembly in which an image bearer and at least one of a charging device that charges the image bearer, a developing device that develops a latent image formed on the image bearer, and a cleaning device that cleans the image bearer are configured to be integrally attachable to and detachable from an image forming apparatus.

Moreover, in the above-described embodiment, the present disclosure has been applied to the developing device 26 in which the two conveyance screws 26*b*1 and 26*b*2 (conveyance members) are aligned in a horizontal direction and the doctor blade 26*c* is disposed below the developing roller 26*a*. However, application of the present disclosure is not limited to such a configuration of the developing device. For example, the present disclosure can be applied to a developing device in which three or more conveyance members are aligned in a horizontal direction, a developing device in which a plurality of conveyance members is aligned in a vertical direction, or a developing device in which a doctor blade is disposed above a developing roller. In the above-described embodiment, moreover, the present disclosure has been applied to the developing device 26 using two-component developer containing toner and carrier. However, the present disclosure can be applied to a developing device using one-component developer containing only toner (including toner additive). In such cases, an effect similar to the effect obtained by the above-described embodiment can be obtained.

In addition, in the above-described embodiment, the present disclosure has been applied such that the bearing 26*m* of the developing roller 26*a* as a rotator is prevented from falling toward both sides in an axial direction. However, the present disclosure can be applied such that bearings of other rotators (e.g., the conveyance screws 26*b*1 and 26*b*2) are prevented from falling toward both sides in an axial direction. In the above-described embodiment, moreover, a ball bearing has been used as the bearing 26*m*. However, the bearing 26*m* is not limited to the ball bearing. For example, a slide bearing can be used as the bearing 26*m*. In the above-described embodiment, the face plate 29 as a positioning determiner that defines a development gap G (an opposed distance) is used as a holder by which the bearing 26*m* is held. However, the holder is not limited to the face plate 29. For example, a side plate, other than a face plate, detachably attachable to a developing device can be used. Even such cases, an effect similar to the effect obtained by the above-described embodiment can be obtained.

The present disclosure is not limited to the above-described embodiment. Within the technical concept of the present disclosure, it is apparent that each embodiment can be changed appropriately other than the suggestions made in the each embodiment. Moreover, positions, shapes, and the number of the above-described components are not limited to the positions, the shapes, and the number of the components described in the embodiment, and various changes can be possible for positions, shapes, and the number of components.

The present disclosure has been described above with reference to specific embodiments but is not limited thereto. Various modifications and enhancements are possible without departing from scope of the disclosure. It is therefore to be understood that the present disclosure may be practiced otherwise than as specifically described herein. For example, elements and/or features of different illustrative embodiments may be combined with each other and/or substituted for each other within the scope of the present disclosure.

What is claimed is:

1. An image forming apparatus comprising:

an image bearer;

a developer to develop a latent image formed on a surface of the image bearer, the developer including a rotator with a rotation shaft;

a bearing to support the rotation shaft;

a holder to hold the bearing;

a first regulator, disposed on the bearing, to regulate movement of the bearing moving toward one end side in an axial direction of the rotation shaft relative to the holder; and a second regulator to regulate movement of the bearing moving toward another end side in the axial direction relative to the holder after the bearing is attached to the holder, wherein the second regulator is on the holder such that the second regulator does not contact the bearing when the bearing is attached to the holder, and is deformed to contact the bearing after the bearing is attached to the holder.

2. The image forming apparatus according to claim 1, wherein the rotation shaft of the developer is attachable to the bearing, wherein the bearing is disposed at a position other than the developer in the image forming apparatus.

3. The image forming apparatus according to claim 1, wherein the first regulator is formed in a hole to which the bearing is to be attached in the holder, and is a small hole having a diameter that is larger than an inner diameter of the bearing and smaller than an outer diameter of the bearing.

4. The image forming apparatus according to claim 1, further comprising an electrode to contact an end surface of the rotation shaft and an end surface of the bearing.

5. The image forming apparatus according to claim 1, wherein the rotator is opposite the image bearer and bear a developer, and wherein the holder is a face plate to define an opposed distance between the image bearer and the rotator.

6. The image forming apparatus according to claim 5, wherein the first regulator is a brim formed on the bearing, and wherein the brim is disposed on an inner side of the face plate in the axial direction.

7. The image forming apparatus according to claim 1, further comprising a plurality of second regulators including the second regulator, wherein the plurality of second regulators is disposed apart from each other in a circumference of the bearing.

8. The image forming apparatus according to claim 7, wherein the plurality of second regulators is disposed such that a proportion of the second regulators excluding all clearance in the circumference of the bearing is 50% or higher.

9. A process cartridge comprising:

an image bearer;

a developer to develop a latent image formed on a surface of the image bearer, the developer including a rotator with a rotation shaft;

a bearing to support the rotation shaft;

a holder to hold the bearing;

a first regulator, disposed on the bearing, to regulate movement of the bearing moving toward one end side in an axial direction of the rotation shaft relative to the holder; and a second regulator configured to regulate movement of the bearing moving toward another end side in the axial direction relative to the holder after the bearing is attached to the holder, wherein the second regulator is on the holder such that the second regulator does not contact the bearing when the bearing is attached to the holder, and is deformed to contact the bearing after the bearing is attached to the holder.

10. The process cartridge according to claim 9, wherein the rotation shaft of the developer is attachable to the bearing, and wherein the bearing is disposed at a position other than the developer in the process cartridge.

11. The process cartridge according to claim 9, wherein the rotator is opposite the image bearer and bear a developer, and wherein the holder is a face plate to define an opposed distance between the image bearer and the rotator.

12. The process cartridge according to claim 9, wherein the first regulator is formed in a hole to which the bearing is to be attached in the holder, and is a small hole having a diameter that is larger than an inner diameter of the bearing and smaller than an outer diameter of the bearing.

13. The process cartridge according to claim 9, further comprising an electrode to contact an end surface of the rotation shaft and an end surface of the bearing.

14. The process cartridge according to claim 9, further comprising a plurality of second regulators including the second regulator, wherein the plurality of second regulators is disposed apart from each other in a circumference of the bearing.

15. The process cartridge according to claim 14, wherein the plurality of second regulators is disposed such that a proportion of the second regulators excluding all clearance in the circumference of the bearing is 50% or higher.

* * * * *